US006112527A

United States Patent [19]

Steinmeyer et al.

[11] Patent Number: 6,112,527

[45] Date of Patent: Sep. 5, 2000

[54] APPARATUS FOR DELIVERING CURRENT TO A COOLED ELECTRICAL DEVICE

[75] Inventors: Florian Steinmeyer; Hans-Peter Krämer, both of Herzogenaurach, Germany

[73] Assignee: Siemens Aktiengesellschaft, Munich, Germany

[21] Appl. No.: 09/370,252

[22] Filed: Aug. 9, 1999

Related U.S. Application Data

[63] Continuation of application No. PCT/DE98/00285, Feb. 2, 1998.

[30] Foreign Application Priority Data

Feb. 7, 1997 [DE] Germany ..... 197 04 485

[51] Int. Cl.[7] ..... F25B 9/00; E21B 33/12

[52] U.S. Cl. ..... 62/6; 62/259.2; 361/712

[58] Field of Search ..... 62/6, 259.2; 361/712

[56] References Cited

U.S. PATENT DOCUMENTS

| | | | |
|---|---|---|---|
| 5,524,441 | 6/1996 | Herrmann et al. | 62/51.1 |
| 5,735,127 | 4/1998 | Pfotenhauer et al. | 62/6 |
| 5,913,888 | 6/1999 | Steinmeyer et al. | 62/51.1 |
| 5,950,444 | 9/1999 | Matsunaga | 62/259.2 |

*Primary Examiner*—William Doerrler
*Attorney, Agent, or Firm*—Herbert L. Lerner; Laurence A. Greenberg; Werner H. Stemer

[57] ABSTRACT

An apparatus for delivering current to a cooled electrical device. The apparatus includes at least one electrical line having a first end at a first temperature and a second end at a second temperature being lower than the first temperature. The second end is provided for connection to the cooled electrical device to deliver current to the cooled electrical device. The cooled electrical device is preferable a superconducting device. At least a portion of the electrical line includes a part of a cold head. The part of the cold head is preferably a regenerator or a pulse tube of a pulse tube cooler.

12 Claims, 4 Drawing Sheets

APPARATUS FOR DELIVERING CURRENT TO A COOLED ELECTRICAL DEVICE

CROSS-REFERENCE TO RELATED APPLICATION

This application is a continuation of copending International application No. PCT/DE98/00285, filed Feb. 2, 1998, which designated the United States.

BACKGROUND OF THE INVENTION

FIELD OF THE INVENTION

The invention relates, in general, to cryogenic systems that include an apparatus configured to deliver current to a cooled electrical device, and in particular, to an apparatus for delivering current to a cooled electrical device. The apparatus has at least one electrical line that runs between a location at a higher temperature level and a location at a respectively lower temperature level. The electrical line has an end at the low-temperature location that is connected to a cooled electrical device. Such an apparatus for delivering current has been described, for example, in the journal "Cryogenics", Vol. 25, 1985, pages 94 to 110.

One of the main problems in the design of cryogenic systems is the efficient introduction of relatively large currents into superconducting or semiconductive devices. Examples of such superconducting or semiconductive devices include those that are used to produce magnetic fields, to provide short-circuit current limiting, to transform voltages, and to transmit power. The greatest source of heat leakage in an insulated cryogenic container is often an electrical conductor of a power supply. The conductor runs between a location at a high temperature level, in particular room temperature at about 300 K, and a location at a lower temperature level of, for example, 77 K which is the temperature of liquid nitrogen $LN_2$. An electrical device such as a superconducting or semiconducting device is at the low temperature location and is preferably maintained at the low temperature. If the electrical conductor or line that runs between the locations of these temperature levels cannot be designed to have low losses, and if the heat losses that are incurred are not effectively dissipated, the cooling cost may call into question the technical or economic purpose of the entire system.

In regard to the design of known apparatus for delivering current to a cooled electrical device, a distinction is drawn between line-cooled and exhaust-gas-cooled types. Line-cooled apparatus for delivering current are in general cooled only by heat conduction from a cold end. The dimensions of the line can be optimized so that the sum of the $I^2R$-losses from the metal in a line having a specific resistance $\rho$ (T) and the transported heat governed by the temperature-dependent thermal conductivity $\lambda$ (T) is a minimum. If the dimensions are optimized, then the specific loss—the heat introduced per unit of current, is about 43 W/kA for copper, based on a single electrical line (see the journal "IEEE Transactions on Magnetics", Vol. MAG-13, No. 1, 1977, pages 690 to 693).

With exhaust-gas-cooled apparatus for delivering current, the enthalpy of a vaporized coolant, for example liquid nitrogen $LN_2$ at a temperature of 77 K or liquid helium LHe at a temperature of 4.2 K, is used to dissipate the introduced heat losses in the opposite direction. The specific loss between 300 K and 77 K can be reduced to about 25 W/kA, with about 0.56 liters of $LN_2$ being vaporized per hour, per kiloampere, and per power supply line.

In a line-cooled apparatus for delivering current, the amount of heat introduced into a cryostat dictates the operating period of the cryogenic system before replenishment of the coolant supply is required. In an exhaust-gas-cooled apparatus for delivering current, the amount of heat introduced into a cryostat dictates the size of the required cooling unit.

The amount of power that must be provided for cooling at room temperature is also important for a user. This power is consumed, for example, in a compressor of a cooling unit or in the production of the liquid coolant.

A number of embodiments of apparatus for delivering current to a cooled electrical device are known. A particular embodiment is selected depending upon the specific application (See the journals referenced above). As a rule, the material used for the electrical line that runs between the locations at different temperature levels is copper or brass. In the case of line-cooled apparatus for delivering current, the cold end is also frequently highly thermally conductive, but is connected in an electrically insulated manner to the cold side of a refrigerator that operates in accordance with the Gifford-McMahon principle. In the case of exhaust-gas-cooled apparatus for delivering current, at least a large proportion of the vaporized coolant is passed along the electrical line. The surface area of the electrical line should be as large as possible so that effective heat exchange takes place.

SUMMARY OF THE INVENTION

It is accordingly an object of the invention to provide an apparatus for delivering current to a cooled electrical device that overcomes the above-mentioned disadvantageous of the heretofore known apparatus of this type, and that has a reduced cryogenic complexity.

With the foregoing and other objects in view there is provided, in accordance with the invention, an apparatus for delivering current to a cooled electrical device. The apparatus includes at least one electrical line having a first end at a first temperature and a second end at a second temperature being lower than the first temperature. The second end is provided for connection to the cooled electrical device to deliver current to the cooled electrical device. The cooled electrical device is preferable a superconducting device. At least a portion of the electrical line includes a part of a cold head. The part of the cold head is preferably a regenerator or a pulse tube of a pulse tube cooler.

A cold head of a pulse tube cooler is a simple component without any mechanically moving parts. Compared to cold heads of conventional cryogenic coolers that operate, for example, using the Gifford-McMahon principle, the cold head of a pulse tube cooler can advantageously be manufactured cheaply and can be insulated against high voltages. The apparatus for delivering current represents, in heating engineering terms, an intermediate form between a line-cooled and an exhaust-gas-cooled power supply. No liquid coolant flows and this results in comparatively less heat being introduced than when using a line-cooled apparatus for delivering current to a cooled device which is preferably a superconductor. The invention combines the advantages of the two conventional types of apparatus for delivering current to a cooled device.

In accordance with an added feature of the invention, the part of the cold head includes an encasing tube.

In accordance with an additional feature of the invention, the regenerator is the part of the cold head, and the encasing tube includes a metallic body disposed therein.

In accordance with an another feature of the invention, the metallic body is a metal mesh, a sintered body, a wire bundle, or at least one of a plurality of sheet-metal strips.

In accordance with a further feature of the invention, the at least one electrical line includes a first electrical line and a second electrical line. The first electrical line includes the regenerator and the second electrical line includes the pulse tube. The first electrical line is electrically insulated from the second electrical line.

In accordance with a further added feature of the invention, the regenerator is disposed physically in parallel with the pulse tube.

In accordance with a further additional feature of the invention, the regenerator is concentrically disposed with respect to the pulse tube.

In accordance with yet an added feature of the invention, the part of the cold head includes a plurality of stages.

In accordance with yet an additional feature of the invention, the part of the cold head includes a first portion and a second portion that is cooler than the first portion, and at least the second portion of the cold head projects into a vacuum area of a vacuum vessel.

In accordance with yet another feature of the invention, the part of the cold head includes a first portion and a second portion that is cooler than the first portion, and at least the second portion of the cold head projects into a vacuum area or an interior of a cryostat.

In accordance with a concomitant feature of the invention, the at least one electrical line includes a first electrical line and a second electrical line. The first electrical line includes the regenerator and the second electrical line includes the pulse tube. The first electrical line is connected electrically in parallel with the second electrical line.

Other features which are considered as characteristic for the invention are set forth in the appended claims.

Although the invention is illustrated and described herein as embodied in an apparatus for delivering current to a cooled electrical device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
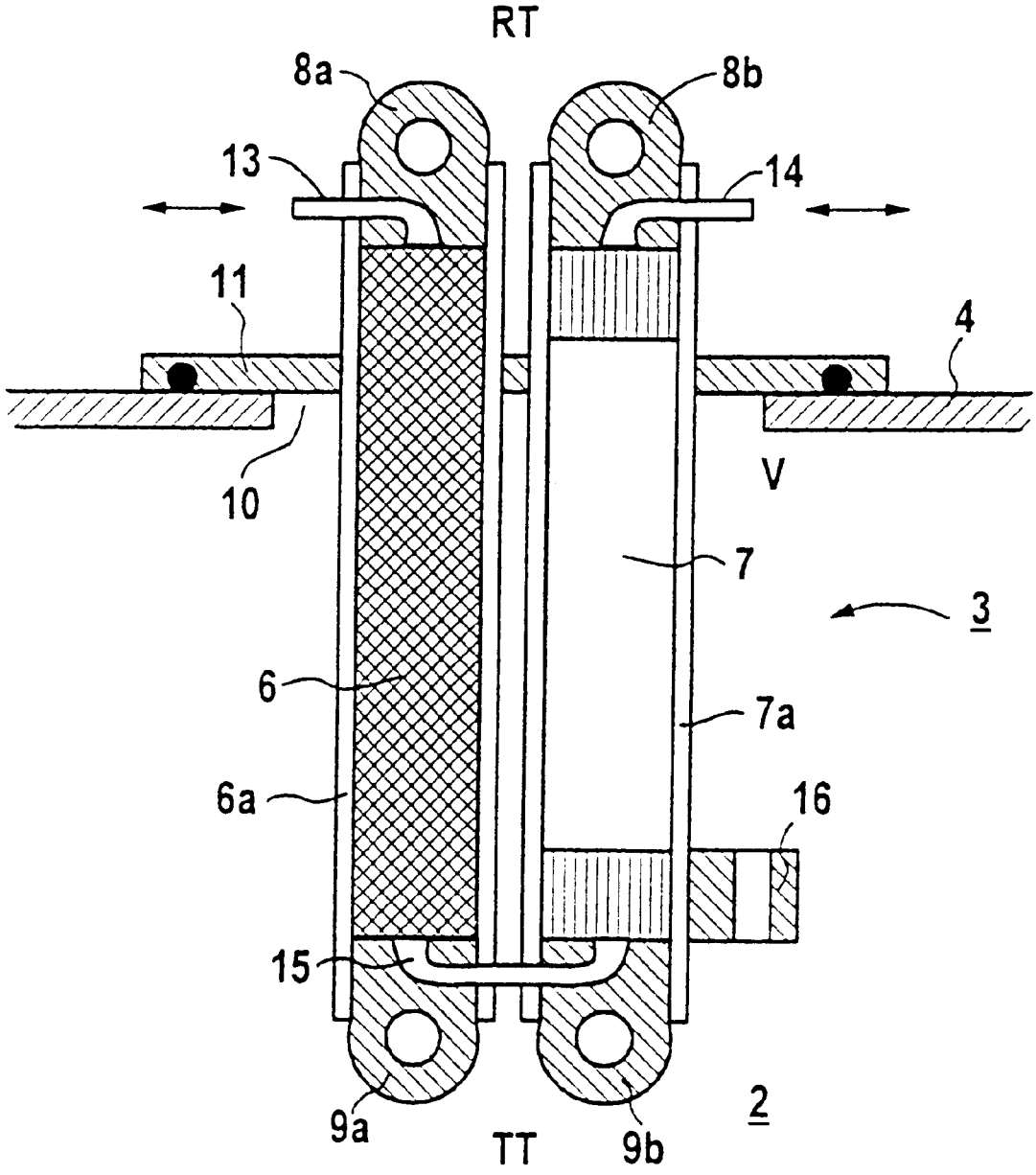
FIG. 1 shows a first embodiment of an apparatus for delivering current to a cooled electrical device.

Referring to the figures of the drawing in detail and first, particularly, to FIG. 1 thereof, there is seen a first preferred embodiment of an apparatus 2 for delivering current to a cooled electrical device. The apparatus 2 in connection with a power supply can deliver current to the cooled electrical device. An electrical power line runs between a relatively hot side (which can be, in particular, at room temperature RT) and a relatively cold side (which can be, for example, at a low temperature TT of 77 K of $LN_2$) through parts of a cold head 3 of a pulse tube cooler. At least the relatively cold part of the cold head 3 projects into the vacuum area V of a vacuum vessel or of a cryostat (identified by the reference numeral 4). The interior of a (bath) cryostat with a cold head 3 or a cold head part can also be provided instead of the vacuum area in a vacuum vessel. The cold head 3 has a regenerator 6 and a pulse tube 7, which are connected to one another through an overflow line 15 at their respective ends on the low-temperature side TT. The electrical line is formed by the encasing tube 6*a* of the regenerator 6 and/or the encasing tube 7*a* of the pulse tube 7, configured in a coaxial or parallel form. The regenerator 6 and pulse tube 7 may be electrically insulated from one another forming two electrical lines that are at different potentials as shown in FIG. 1. Alternatively, the regenerator 6 and pulse tube 7 may be electrically connected in parallel. The electrical connections 8*a* and 8*b* are located at the relatively hot temperature level RT, and corresponding electrical connections 9*a* and 9*b* are located at the relatively low temperature level TT. The apparatus 2 includes an installation opening 10 for installing the cold head 3 in the vacuum or cryostat vessel 4. An insulating mounting flange 11 holds the cold head 3 on its relatively hot side and ensures that a vacuum-tight or gas-tight seal is provided for the installation opening 10. A gas inlet and/or outlet 13 is provided on the regenerator, and a gas inlet and/or outlet 14 is provided on the pulse tube. An electrically insulating overflow line 15 is provided between the regenerator 6 and the pulse tube 7. The apparatus 2 includes a connection for a thermal bus 16. An external power supply unit, which is at room temperature RT, can be connected to the electrical connections 8*a* and 8*b*, while a cooled electrical device, which in general has to be kept at low temperature TT, is connected to the electrical connections 9*a* and 9*b*. The cooled electrical device can be, for example, a cable, a current limiter, a magnet field winding, or parts of an electronic device. The cooled electrical device preferably includes superconducting material. An LHe cooling technique can generally be provided for classical superconducting materials such as $Nb_3Sn$ or NbTi. An $LN_2$ cooling technique can generally be provided for metal-oxide superconducting materials with a high critical temperature, such as those of the Y—Ba—Cu—0— or the (Bi, Pb)—Sr—Ca—Cu—0— types. The electrical device may, however, also have normally conductive or semiconductive parts to be cooled and does not necessarily need to be exactly at the temperature level TT.

Figure 2:
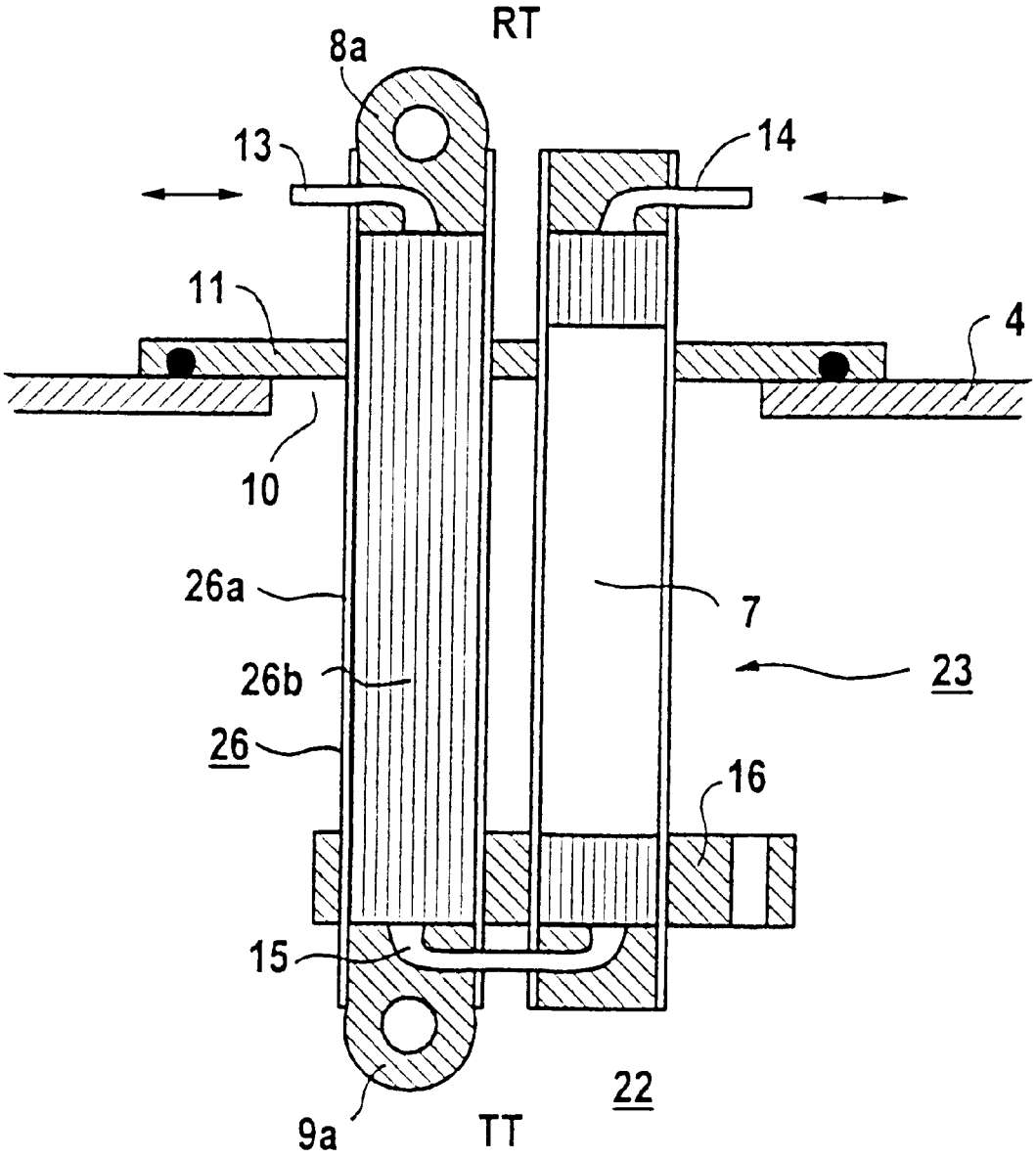
FIG. 2 shows a second embodiment of an apparatus for delivering current to a cooled electrical device.

Referring, in particular, to FIG. 2 thereof, there is seen a second preferred embodiment of an apparatus 22 for delivering current to a cooled electrical device. The second preferred embodiment of the apparatus 22 for delivering current to a cooled electrical device differs from the first embodiment shown in FIG. 1 in that only the regenerator 26 of a cold head 23 of a pulse tube cooler is used for carrying electrical power. As a current-carrying part, the regenerator 26 contains a metallic body in the form of, for example, a tightly rolled metal mesh 26*b* that is packed into its encasing tube 26*a*. Instead of the metal mesh 26*b*, it is also possible to use a porous body composed of sintered metal granules, a bundle of thin wires, at least one thin rolled or folded sheet-metal strip, or a number of profiled metal sheets. Electrical contact is made with these metallic bodies at the hot end and at the cold end by, for example, soldering, welding or pressing. A bundle of thin wires is particularly suitable for introducing alternating current, since the wire thickness can be matched to the skin depth. However, fine wire meshes provide considerably better thermal conduction in the regenerator 26 than a stack, so this version of the embodiment is preferably considered only with comparatively high current levels.

In the apparatus 2, 22 shown in FIGS. 1 and 2, electrical insulation is advantageously ensured by dielectrics, for example plastics and/or ceramic. Sapphire, beryllium oxide or aluminum nitride, which advantageously have high thermal conductivity, are also preferably used at the end on the low-temperature side. This allows thermal coupling to other components that are to be cooled, for example radiation shields or electrical or magnetic apparatus. Potential isolation between a compressor which possibly has an electrical valve drive and the apparatus 2, 22 can be achieved, for example, by an insulating connecting tube which may be made from plastic, fiber-reinforced plastic or ceramic, for example.

The pulse tube coolers that can be used for the apparatus 2, 22 for delivering current to a cooled electrical device are based on embodiments that are known (see, for example, "Cryocoolers 8", Plenum Press, New York, 1994, pages 345 to 410; or "Advances in Cryogenic Engineering", Vol. 35, Plenum Press, New York, 1990, pages 1191 to 1205; or "INFO PHYSTECH" from the VDI Technology Center, No. 6/Feb. 2996, entitled: "Pulsrbhrenkuhler: Neue K ältemaschinen für die Supraleitungstechnik und Kryoelektronik" [Pulse tube coolers: new cooling machines for superconductivity and cryoelectronics] 4 pages; or U.S. Pat. No. 5,335,505 A).

Figure 3:
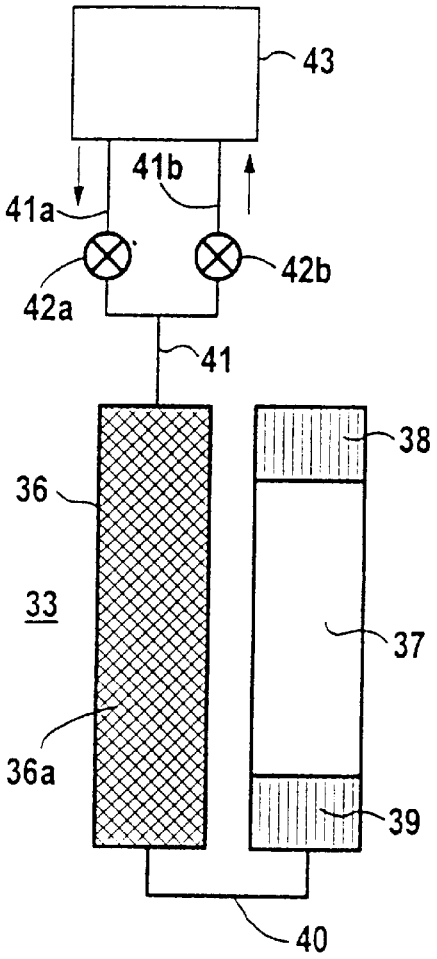
FIGS. 3 to 7 show various embodiments of pulse tube coolers.

Referring, in particular, to FIG. 3 thereof, there is seen a pulse tube cooler that has a cold head 33 having a relatively cold part that is in general surrounded by an insulating vacuum. This cold head 33 has two tubes that are connected to one another. One tube is in the form of a regenerator 36 and contains a body in its interior that periodically temporarily stores the gas heat. The body can be, for example in the form of stacked metal meshes 36*a* with a narrow mesh width. In the second embodiment of the apparatus 22 shown in FIG. 2, this body is used to carry electrical current or power. The other tube is pulse tube 37 that has heat exchangers 38 and 39, that can be formed by fine copper meshes. A respective heat exchanger 38, 39 is located at the hot and cold ends of the pulse tube 37 which is otherwise hollow. The regenerator 36 and the pulse tube 37 are not necessarily tubular and are connected by an overflow channel 40 for a coolant at their ends at low temperature TT side. A first supply line 41 is used to supply the regenerator 36 with a working gas (for example helium gas). The working gas is generally not cooled and is provided at room temperature RT, at a high pressure produced by the valve drive 42*a* and pulsating at a frequency of, for example, between 2 Hz and 50 Hz. The working gas is also carried away by a valve drive 42*b* and through the supply line 41 during a low-pressure phase of the pulse tube cooler. At its room-temperature end, the pulse tube 37 can be connected through a connecting channel (not illustrated) to a second supply line which, depending on the type of pulse tube cooler, leads to a further valve drive (not illustrated) or to a buffer volume having a size of, for example, several liters (see FIGS. 5 to 7). FIG. 3 also shows a compressor 43 that is connected to the first connecting line 41 through a forward line 41*a* with a high-pressure valve 42*a* disposed in the line 41*a* for providing the working gas at a high pressure. A return line 41*b* is provided with a low-pressure valve 42*b* disposed in the line 41*b* for receiving the working gas at a low pressure.

Figure 4:
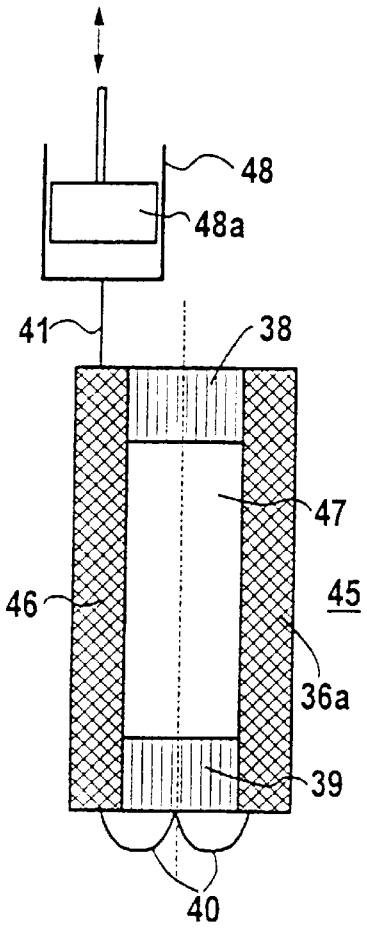

In the embodiment of the cold head 33 of a pulse tube cooler shown in FIG. 3, the regenerator 36 and the pulse tube 37 are arranged physically parallel or physically one behind the other. Referring, in particular, to FIG. 4 thereof, there is seen an embodiment of a cold head 45 of another pulse tube cooler. The pulse tube 47 and the regenerator 46 that surrounds it are arranged concentrically (coaxially). In this embodiment, the working gas is conveyed by means of a pumping apparatus 48 having a working piston 48*a*.

A pressure wave produced by the working piston 48*a* or by the compressor 43 with the valve drive is introduced periodically into the regenerator 36 or 46, is pre-cooled in the regenerator 36 or 46, respectively, and is expanded in the pulse tube 37 or 47, respectively, so as to produce a useable cooling performance. The expanded, cold gas then cools the regenerator 36 or 46 as it flows out of the pulse tube 37 or 47.

Figure 7:
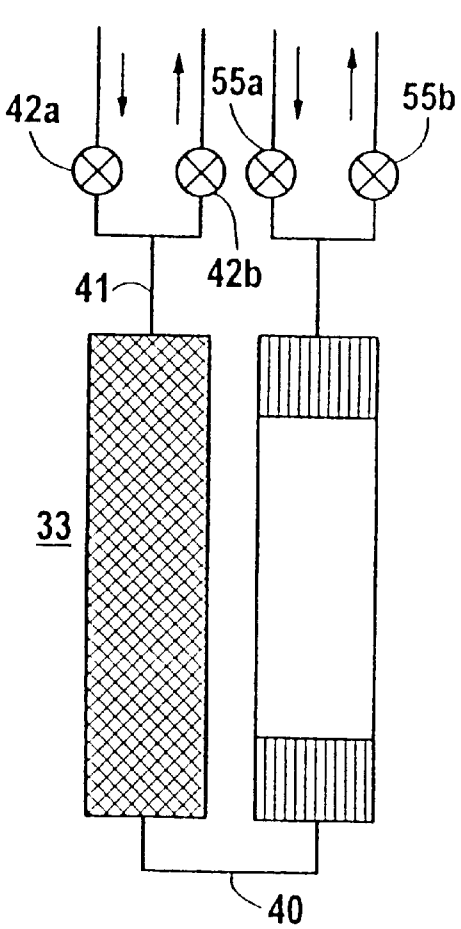
Figure 6:
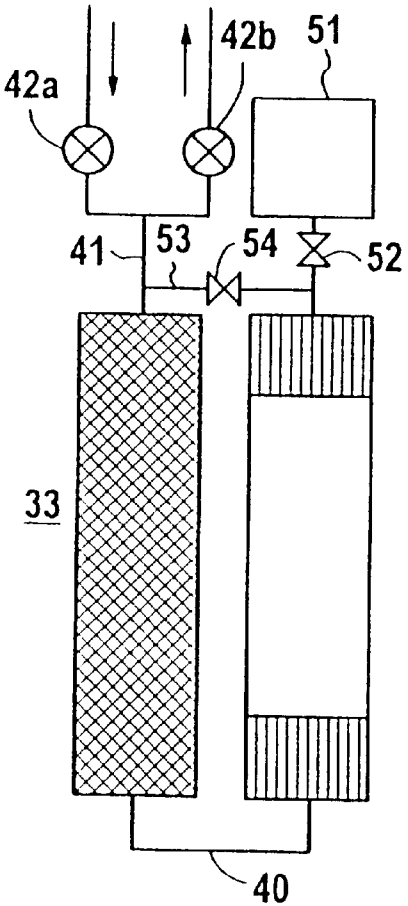
Figure 5:
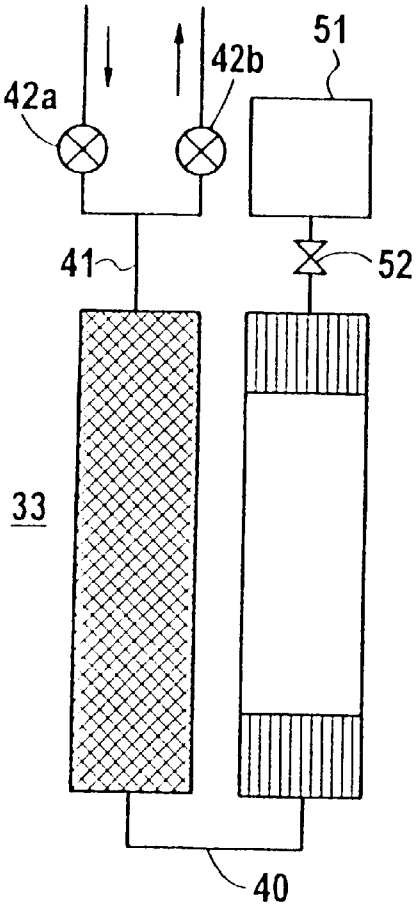

Referring, in particular, to FIGS. 5–7 thereof, there are seen embodiments of corresponding phase converters at the hot end of the pulse tube based on a cold head 33 as shown in FIG. 3. FIG. 5 shows a buffer volume 51 with a restrictor 52 provided for this purpose. FIG. 6 shows a second inlet from the relatively hot regenerator side produced using a line 53 with a nozzle 54. FIG. 7 shows a corresponding phase converter formed by four valves 42*a*, 42*b*, 55*a* and 55*b*.

Furthermore, the apparatus for delivering current to a cooled electrical device can also utilize two-stage and multistage versions of pulse tube coolers (see, for example the Journal "Cryogenics", Vol. 34, 1994, pages 259 to 262).

Embodiments of the apparatus for delivering current to a cooled electrical device other than those illustrated in FIGS. 1 and 2 are, of course, also feasible. For example, design features of the apparatus 2 according to FIG. 1 and of the apparatus 22 according to FIG. 2 can be combined, so that the electric current then flows both inside the regenerator and over its encasing tube. All of the versions can also be designed both coaxially and in a parallel form, with one, two or more electrical lines at different potentials in one cold head being feasible. A plurality of apparatus for delivering current can also be operated from one compressor. If one cooling stage is not sufficient for a specific application, two-stage or multistage versions can also be constructed by connecting the relatively hot end of a further, relatively cold stage to the cold end of the relatively hot stage. A corresponding configuration may be regarded as a plurality of cold heads being thermally connected in series.

The integration according to the invention of at least one cold head of a pulse tube cooler in an apparatus for delivering current to a cooled electrical device achieves a number of significant advantages over known embodiments:

The heat losses are considerably reduced in comparison with a line-cooled apparatus for delivering current to a cooled electrical device. Specifically, apparatus 2 shown in FIG. 1 uses the electrical conductivity of the encasing tube 6*a* of the regenerator 6 and of the encasing tube 7*a* of the pulse tube 7 to deliver an electric current to a cooled electrical device such as a superconductor. The encasing tubes 6*a* and 7*a* are relatively solid anyway to withstand an operating pressure of, typically, 20 bar of helium gas. For example, a stainless steel tube with a wall thickness of 1 mm, a diameter of 20 mm, and a length of 200 mm can optimally carry a current of 32 A. The losses in comparison with apparatus for delivering current that are cooled only indirectly by a pulse tube cooler are reduced to one third when loaded with the rated current. When no current is flowing, there is no additional heat leakage whatsoever. At high current levels, greater wall thicknesses and/or materials having higher specific conductivity are advantageously used, such as brass, bronze or copper. A further reduction in the losses is obtained by the reverse flow cooling effect in the regenerator 6 and pulse tube 7, which is obtained by the cold working gas. To enhance this effect further, other improvements may suitable, for example, tubes with a variable cross section or additional heat exchangers at different heights in the pulse tube. An enlarged surface area, for example with special ribs, or by roughening or sintering the inner surfaces with a porous metal, can also be provided. The saving in the case of the apparatus 22 according to FIG. 2 is particularly great since an optimized regenerator 26 has a large surface area anyway. Therefore, cooling by the cold working gas is particularly thermodynamically effective.

A cost savings is achieved because the cold head in the apparatus 2, 22 is not a separate component. The apparatus 2, 22 which are cooled in an integrated manner, also operate in a well-natured manner cryogenically since there is no need to introduce a hot end piece into a cryostat system which must first be coupled, with a considerable design penalty, to a cold reservoir.

The integral design of the apparatus 2, 22 and the pulse tube cooler enables the cooling power of the pulse tube cooler to be optimally matched to the losses in the apparatus 2, 22. This makes it possible to save losses that often occur from the necessity to de-rate the cooler.

Provided the cooling power at the cold end can be selected to be large enough at, for example, 77 K, it is possible to compensate for other cryostat losses, for example as a result of thermal incident radiation, without any further cooling unit or subsequent supply of cryogenic liquids.

The simple design enables feasible economic matching to the power requirement of a given cryogenic system, even with a modular structure, in which a plurality of apparatus 2, 22 are connected to a common compressor with a valve drive.

Conventional apparatus for delivering current to a cooled electrical device, which are optimized for a specific rated current, may form condensation or even ice up at the hot end if the $I^2R$ heat is reduced at low current. In this case, for high-voltage apparatus for delivering current, there is a risk of the flashover resistance being reduced. With the apparatus 2, 22 that are cooled in an integrated manner, this effect can be counteracted by a corresponding reduction in the cooling power, in a simple manner. This is accomplished, for example, by reducing the operating frequency of the valve drive or of the piston that produces a periodic helium pressure wave.

We claim:

1. In an apparatus for delivering current to a cooled electrical device, the improvement comprising:

at least one electrical line having a first end at a first temperature and a second end at a second temperature lower than the first temperature, said second end for connection to the cooled electrical device to deliver the current;

at least a portion of said electrical line including a part of a cold head, said part of said cold head selected from the group consisting of a regenerator and a pulse tube of a pulse tube cooler.

2. The apparatus according to claim 1, wherein said part of said cold head includes an encasing tube.

3. The apparatus according to claim 2, wherein said regenerator is said part of said cold head, and said encasing tube includes a metallic body disposed therein.

4. The apparatus according to claim 3, wherein said metallic body is selected from the group consisting of a metal mesh, a sintered body, a wire bundle, one sheet-metal strip, and a plurality of sheet-metal strips.

5. The apparatus according to claim 1, wherein said at least one electrical line includes a first electrical line and a second electrical line, said first electrical line includes said regenerator and said second electrical line includes said pulse tube, said first electrical line electrically insulated from said second electrical line.

6. The apparatus according to claim 5, wherein said regenerator is disposed physically in parallel with said pulse tube.

7. The apparatus according to claim 5, wherein said regenerator is concentrically disposed with respect to said pulse tube.

8. The apparatus according to claim 1, wherein said part of said cold head includes a plurality of stages.

9. The apparatus according to claim 1, wherein said part of said cold head includes a first portion and a second portion that is cooler than said first portion, and at least said second portion of said cold head projects into a vacuum area of a vacuum vessel.

10. The apparatus according to claim 1, wherein said part of said cold head includes a first portion and a second portion that is cooler than said first portion, and at least said second portion of said cold head projects into a vacuum area or an interior of a cryostat.

11. The apparatus according to claim 1, wherein said at least one electrical line includes a first electrical line and a second electrical line, said first electrical line includes said regenerator and said second electrical line includes said pulse tube, said first electrical line connected electrically in parallel with said second electrical line.

12. In combination with a superconducting device, an apparatus for delivering current to the superconducting device, comprising:

at least one electrical line having a first end at a first temperature and a second end at a second temperature lower than the first temperature, said second end connected to the superconducting device to deliver the current;

at least a portion of said electrical line including a part of a cold head, said part of said cold head selected from the group consisting of a regenerator and a pulse tube of a pulse tube cooler.

* * * * *